US007878672B2

(12) United States Patent
Yang

(10) Patent No.: US 7,878,672 B2
(45) Date of Patent: Feb. 1, 2011

(54) DOOR KNOB HAVING ILLUMINATIVE LIGHTING

(76) Inventor: Chin-Sheng Yang, 4F., No. 26, Lane 358, Yung-An St., Tainan City (TW)

( * ) Notice: Subject to any disclaimer, the term of this patent is extended or adjusted under 35 U.S.C. 154(b) by 302 days.

(21) Appl. No.: 12/241,084

(22) Filed: Sep. 30, 2008

(65) Prior Publication Data

US 2009/0122522 A1 May 14, 2009

(30) Foreign Application Priority Data

Nov. 12, 2007 (TW) ..... 96219032 U

(51) Int. Cl.
*E05B 17/10* (2006.01)

(52) U.S. Cl. ..... 362/100; 362/184

(58) Field of Classification Search ..... 362/100, 362/184, 501

See application file for complete search history.

(56) References Cited

U.S. PATENT DOCUMENTS 5,398,175 A * 3/1995 Pea ..... 362/100

* cited by examiner

*Primary Examiner*—David V Bruce
(74) *Attorney, Agent, or Firm*—Leong C. Lei

(57) ABSTRACT

The door knob contains a body assembly having a transparent cap member, a touch-sensitive member, and a connection member, joined together in this order along an axial direction of the door knob. The cap member is filled with a fluid of high viscosity dispersed with spangles. The touch-sensitive member contains a power element, a switch element that is turned on by electrostatics or vibration, and at least a light generating element. When the door knob is touched by hand, the switch element is closed by the electrostatics of the hand or the vibration of the door knob. By the received electricity from the power element, the light generating elements are turned on and the light penetrates through the transparent cap member to provide illumination.

11 Claims, 4 Drawing Sheets

DOOR KNOB HAVING ILLUMINATIVE LIGHTING

TECHNICAL FIELD OF THE INVENTION

The present invention generally relates to door knobs or door handles, and more particularly to a door knob or handle having a built-in light generating device that is turned on by hand contact.

DESCRIPTION OF THE PRIOR ART

When people open a door at night or where there is no adequate lighting, finding the key hole of the door lock could be quite frustrate. Automobile manufacturers have long ago solved a similar problem of driver's finding the ignition key hole by having some illuminative light around the ignition that is turned on automatically when the vehicle door is opened. For motor vehicles, this could be easily achieved as the vehicle has a built-in electrical system. In contrast, an ordinary household door does not have such a built-in electrical source and providing similar illuminative light around the door knob or handle is difficult.

SUMMARY OF THE INVENTION

Accordingly, a novel door knob is provided herein. The door knob contains a body assembly having a transparent cap member, a touch-sensitive member, and a connection member, joined together in this order along an axial direction of the door knob. The cap member is filled with a fluid of high viscosity dispersed with spangles. The touch-sensitive member contains a power element, a switch element that is turned on by electrostatics or vibration, and at least a light generating element. When the door knob is touched by hand, the switch element is closed by the electrostatics of the hand or the vibration of the door knob. By the received electricity from the power element, the light generating elements are turned on and the light penetrates through the transparent cap member to provide illumination.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 4 is a sectional diagram showing the door knob of FIG. 1 when its light generating elements are turned on.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
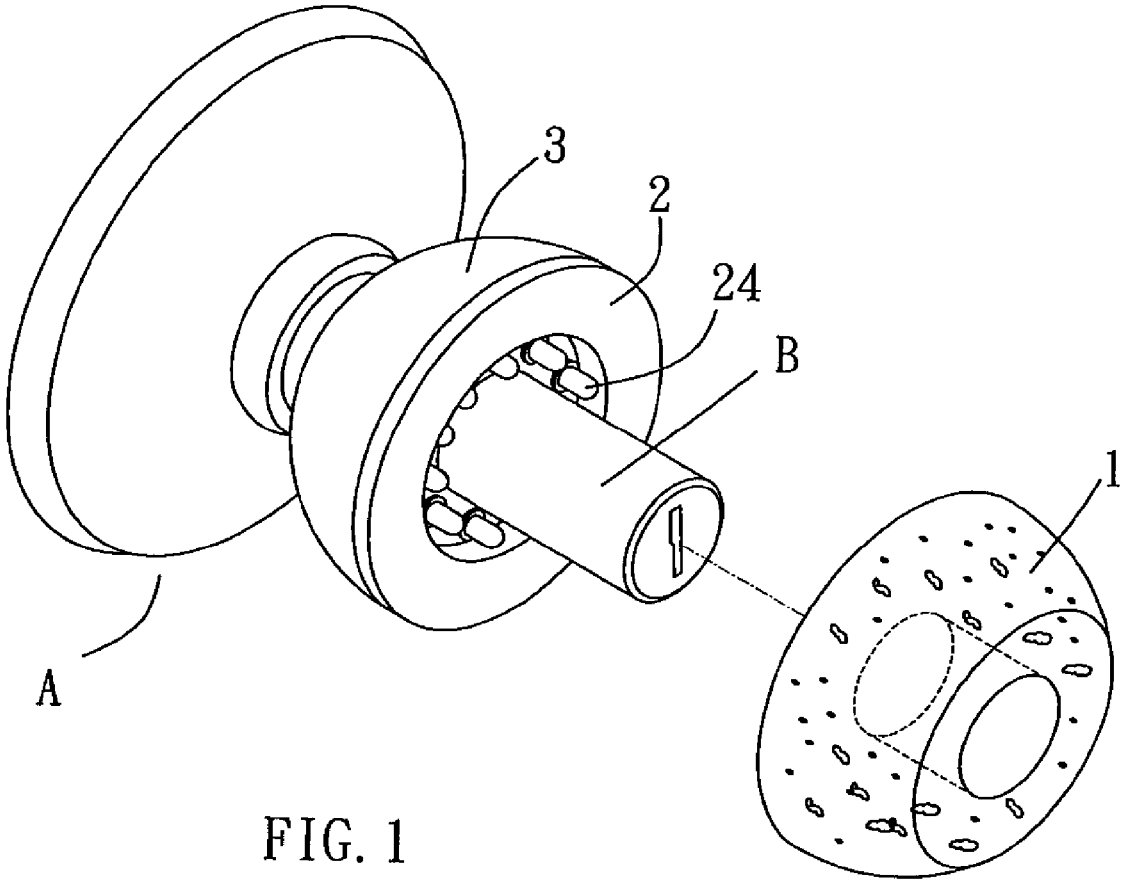
FIG. 1 is a perspective diagram showing a door knob according an embodiment of the present invention.

As shown in FIG. 1, a door knob according to an embodiment of the present invention contains a body assembly A having a cap member 1, a touch-sensitive member 2, and a connection member 3, joined together in this order along an axial direction of the door knob. An elongated core member B for engaging and disengaging a door lock extends along the axial direction through the connection member 3, the touch-sensitive member 2, and the cap member 1, and has a front end with a key hole exposed from the cap member 1.

The cap member 1 has a hollow and transparent casing filled with a fluid of high viscosity dispersed with spangles or similar glittery powder, particles, etc. The cap member 1 could have any appropriate shape for easy hand operation and holding.

Figure 2:
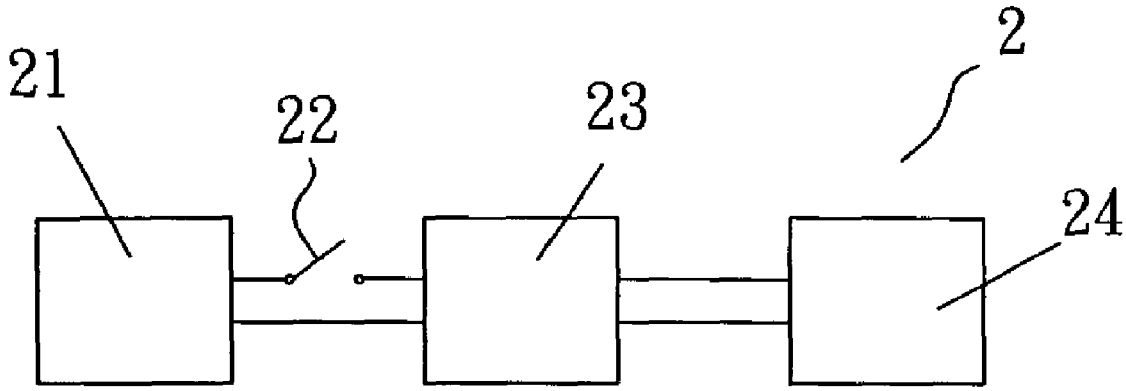
FIG. 2 is a functional diagram showing the components of the touch-sensitive member of the door knob of FIG. 1.

As shown in FIG. 2, the touch-sensitive member 2 contains a power element 21, a switch element 22, a control element 23, and at least a light generating element 24, connected in series in the foregoing order. The power element 21 could be a small mercury battery and the switch element 22 is a micro switch that is turned on (i.e., closed) by sensing electrostatics or by light vibration. When the switch element 22 is turned on/off, electricity from the power element 21 is conducted to/disrupted from the control element 23 and the light generating elements 24. The light generating elements 24 could be light emitting diodes and are preferably arranged to surround the core member B. The light produced by the light generating elements 24 projects towards the transparent cap member 1.

Figure 3:
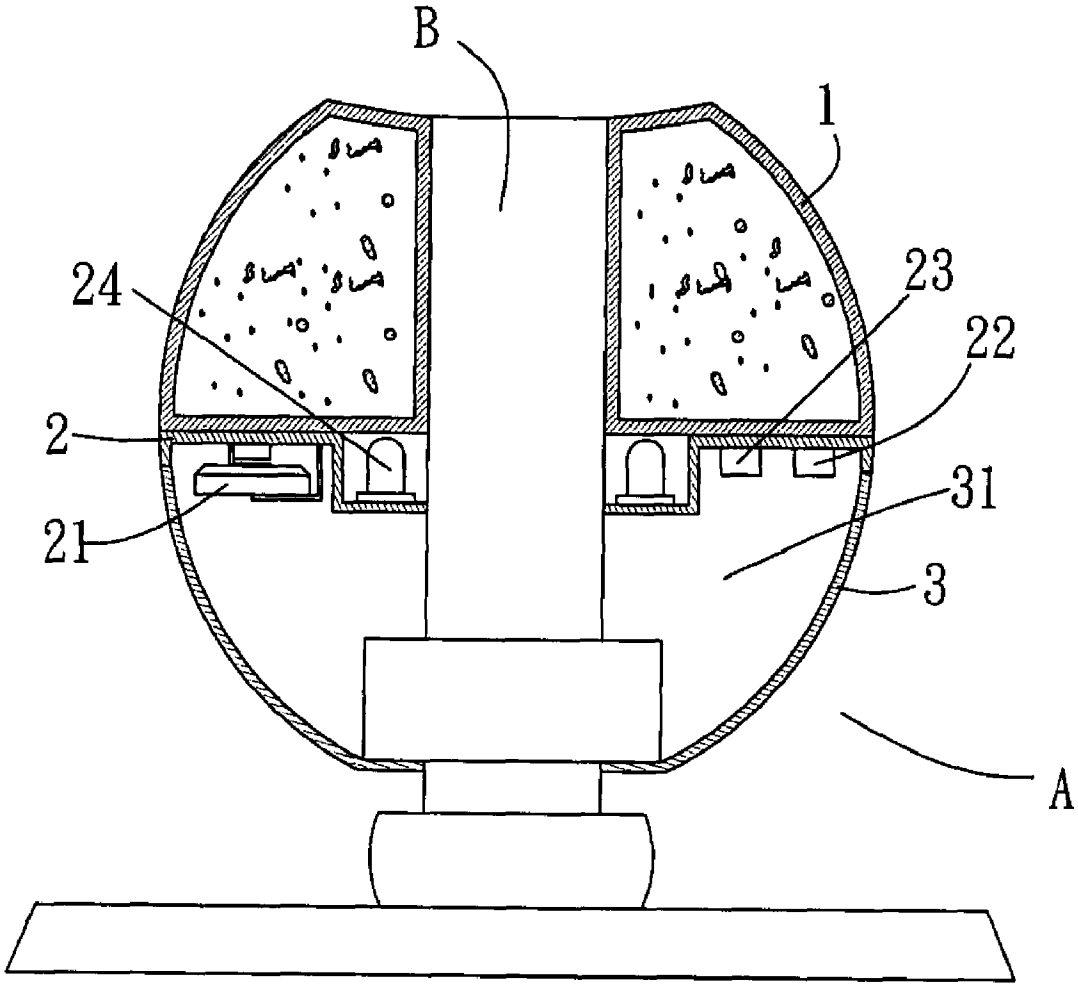
FIG. 3 is a sectional diagram showing the door knob of FIG. 1.
Figure 4:
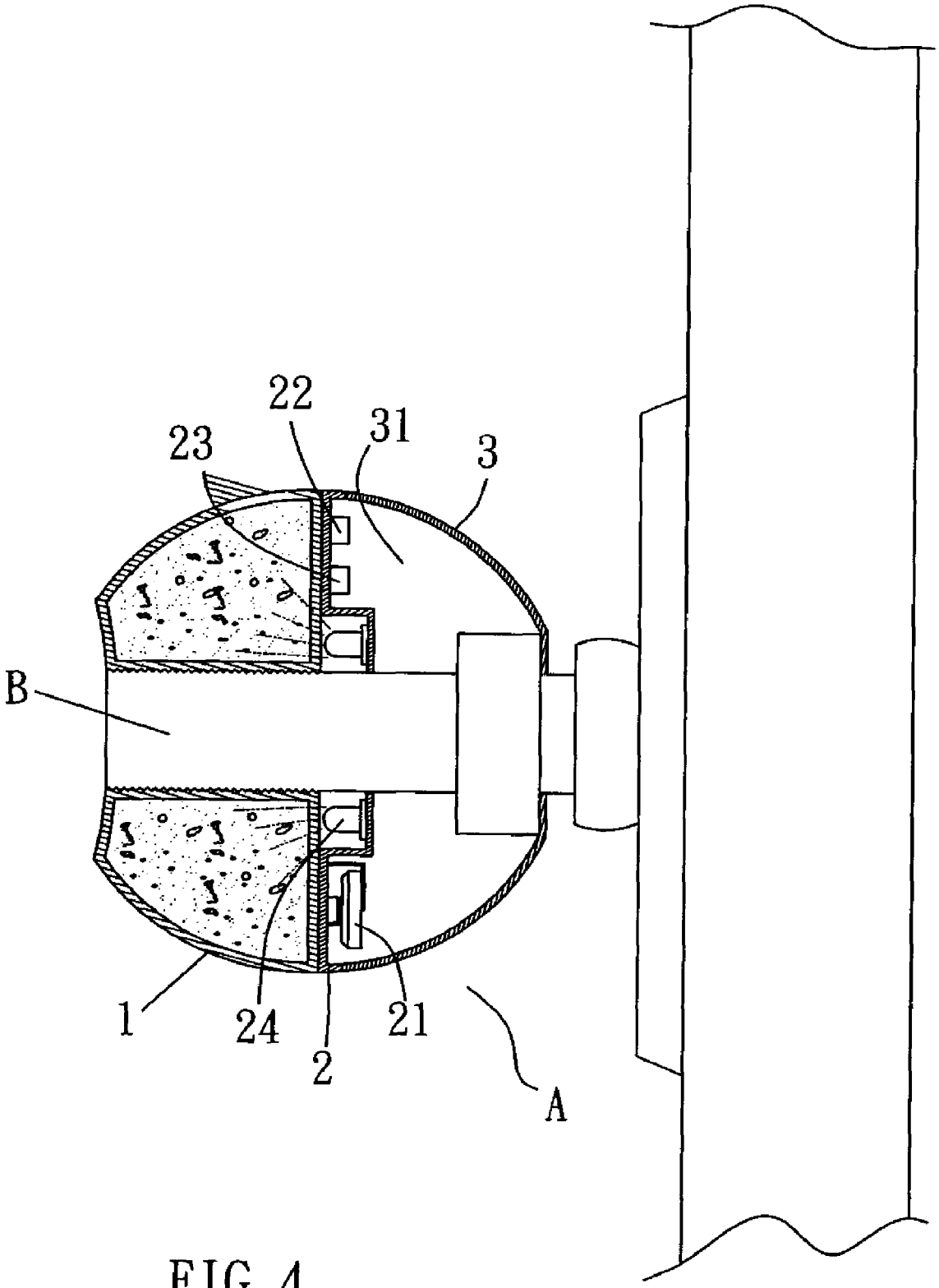

As shown in FIG. 3, the connection member 3 has a hollow chamber 31 for housing the power element 21, the switch element 22, the control element 23, and the light generating elements 24 of the touch-sensitive member 2.

The assembly of the door knob is as follows. The connection member 3 is first sleeved over the core member B. Then, the various components of the touch-sensitive member 2 are positioned in the chamber 31 of the connection member 3 with the light generating elements 24 positioned so that their light is projected towards a front direction. The cap member 1 is then sleeved over the core member B and joined to connection member 3 to seal the various components of the touch-sensitive member 2. The joint between the connection member 3 and the cap member 1 could be a detachable one for easy replacement of the cap member 1 and maintenance.

When the connection member 3 or the cap member 1 of the door knob is touched by hand, the switch element 22 is closed by the electrostatics of the hand or the vibration of the door knob. By the received electricity from the power element 21, the light generating elements 24 are turned on and the light penetrates through the transparent cap member 1 to provide illumination to the key hole. Further more, the reflection from the spangles or glittery powder inside the cap member 1 delivers an appealing visual effect. Please note that the control element 23 is positioned in the electrical path between the power element 21 and the light generating elements 24 and could have a number of functions. In one embodiment, the control element 23 would open the switch element 22 after a preset period of time so that the light generating elements 24 would be turned on only for a fixed period of time. In an alternative embodiment, the control element 23 could provide intermittent conduction of electricity to the light generating elements 24 within a preset period of time so that, when touched, the door knob flashes for a fixed period of time.

In addition to provide adequate lighting so that the key hole could be easily located at night or in a dimly lit environment, the door knob of the present invention could actually provide interesting and appealing visual effect, increasing the market value of the door knob.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A door knob having a body assembly and an elongated core member for engaging a door lock, said body assembly comprising:

a connection member sleeved over said core member, said connection member having a hollow chamber;

a transparent cap member sleeved over said core member and joined to said connection member, said cap member exposing a front end with a key hole of said core member; and a touch-sensitive member having a power element, a switch element, and at least a light generating element, connected in series and all housed in said chamber and sealed by said cap member, said light generating element being positioned so that its light projects towards said cap member;

wherein, when said door knob is touched by hand, said switch element is closed by the electrostatics of said hand or by the vibration of said door knob; and, by the received electricity from said power element, said light generating element is turned on and the light penetrates through said cap member to provide illumination to said key hole.

2. The door knob according to claim 1, wherein said cap member is hollow and filled with a fluid of high viscosity.

3. The door knob according to claim 2, wherein said fluid is dispersed with a plurality of spangles.

4. The door knob according to claim 2, wherein said fluid is dispersed with glittery powder.

5. The door knob according to claim 1, wherein said cap member is detachably joined to said connection member.

6. The door knob according to claim 1, wherein said touch-sensitive member further comprises a control element connected in series between said power element and said light generating element.

7. The door knob according to claim 1, wherein said light generating element is a light emitting diode.

8. The door knob according to claim 1, wherein said power element is a mercury battery.

9. The door knob according to claim 1, wherein a plurality of said light generating elements surround said core member.

10. The door knob according to claim 6, wherein said control element conducts electricity to said light generating element intermittently.

11. The door knob according to claim 6, wherein said control element conducts electricity to said light generating element for a period of time.

* * * * *